US008992400B2

(12) United States Patent
Righetti et al.

(10) Patent No.: US 8,992,400 B2
(45) Date of Patent: Mar. 31, 2015

(54) MACHINE AND METHOD FOR MANUFACTURING COMPOSITE FILTERS

(75) Inventors: Mario Righetti, Bologna (IT); Alberto Stagni, Bologna (IT); Massimo Sartoni, Bologna (IT)

(73) Assignee: G.D S.p.A. (IT)

( * ) Notice: Subject to any disclaimer, the term of this patent is extended or adjusted under 35 U.S.C. 154(b) by 845 days.

(21) Appl. No.: 13/172,299

(22) Filed: Jun. 29, 2011

(65) Prior Publication Data

US 2012/0010059 A1 Jan. 12, 2012

(30) Foreign Application Priority Data

Jul. 8, 2010 (IT) ..... BO2010A0433

(51) Int. Cl.
*B31C 99/00* (2009.01)
*A24D 3/02* (2006.01)

(52) U.S. Cl.
CPC ..... *A24D 3/0287* (2013.01); *A24D 3/0295* (2013.01)
USPC ..... 493/39; 493/4; 493/47

(58) Field of Classification Search
CPC . A24D 3/0229; A24D 3/0208; A24D 3/0254; A24D 3/0287; A24D 3/0204; D02J 1/18
USPC ..... 493/39, 4, 41, 42, 45, 47, 50; 131/27.1, 131/57.5, 60, 64.2, 111, 280
See application file for complete search history.

(56) References Cited

U.S. PATENT DOCUMENTS 2,657,433 A * 11/1953 Merriman ..... 34/628
3,032,829 A * 5/1962 Mahoney et al. ..... 19/65 T
4,103,596 A 8/1978 Molins
(Continued)

FOREIGN PATENT DOCUMENTS

CN 101164458 4/2008
CN 101185530 5/2008
(Continued)

OTHER PUBLICATIONS

Italian Search Report dated Feb. 15, 2011 from corresponding foreign application.
(Continued)

*Primary Examiner* — Stephen F Gerrity
*Assistant Examiner* — Joy N Sanders
(74) *Attorney, Agent, or Firm* — Timothy J. Klima; Shuttleworth & Ingersoll, PLC

(57) ABSTRACT

In a machine and a method for manufacturing composite filters (F1, F2) for cigarettes or the like, a feed conveyor (S) supplies filter groups (G1, G2) in pairs to two respective feed lines (L1, L2) of a station (16) for forming two continuous filter rods (B1, B2); the machine (100) comprises at least one transfer device (DT) by which the filter groups (G1, G2) are taken up from the feed conveyor (S) and directed along the feed lines (L1, L2), and at least one release device (R), operating along the two feed lines (L1, L2), by which the two filter groups (G1, G2) are taken up from the transfer device (DT) and released in phase one with another along the selfsame feed lines (L1, L2); the rate at which the filter groups (G1, G2) are released by the release device (R) is governed according to the phase value of at least one of the continuous filter rods (B1, B2) relative to the cyclic cutting operation whereby the two filter rods (B1, B2) are cut transversally to make the composite filters (F1, F2).

20 Claims, 6 Drawing Sheets

(56) References Cited

U.S. PATENT DOCUMENTS

| | | | | |
|---|---|---|---|---|
| 6,142,154 | A * | 11/2000 | Dall'Osso et al. | 131/60 |
| 7,165,668 | B2 * | 1/2007 | Dombek | 198/459.8 |
| 2005/0051181 | A1 * | 3/2005 | Okamoto | 131/60 |
| 2009/0145449 | A1 * | 6/2009 | Cieslikowski et al. | 131/280 |

FOREIGN PATENT DOCUMENTS

| | | |
|---|---|---|
| DE | 102009041318 | 3/2011 |
| EP | 1767107 | 3/2007 |
| EP | 1787534 | 5/2007 |
| EP | 1913824 | 4/2008 |
| EP | 1913825 | 4/2008 |
| FR | 2354719 | 1/1978 |
| WO | 2006000918 | 1/2006 |

OTHER PUBLICATIONS

Office Action dated Jul. 7, 2011 issued by the Chinese Patent Office for parallel Chinese patent applicated No. 201110199101.2.
Office Action issued Aug. 12, 2014 by the German Patent Office for counterpart German patent application No. 10 2011 106 947.3.

* cited by examiner

MACHINE AND METHOD FOR MANUFACTURING COMPOSITE FILTERS

This application claims priority to Italian Patent Application B02010A000433 filed Jul. 8, 2010, the entirety of which is incorporated by reference herein.

BACKGROUND OF THE INVENTION

This invention relates to a machine and a method for manufacturing composite filters, that is to say, filters comprising two or more filter plugs.

The term "composite filter" means a cigarette filter obtained by joining end-to-end two or more filter plugs having different filtration properties and/or made of different materials.

Document EP1787534, in the name of the same Applicant as this invention, discloses a twin-track machine for manufacturing composite filters. It involves dividing up at least two segments of filter material, supplied to respective reservoirs, to make filter plugs from them.

These filter plugs are transferred along a direction transverse to their longitudinal axes by a train of rotating transfer rollers of known type.

The machine comprises an assembling unit designed to place in axial end-to-end contact at least two plugs obtained from two different segments of filter material to obtain filter groups.

The filter groups are taken up and transferred in pairs by a single rotating member presenting circumferential carriers, each furnished with two flutes connected to suction means.

Each flute receives and accommodates a filter group.

The rotating member releases the filter groups in pairs to a pair of conveyors of a garniture tongue which forms two "filter rods".

The garniture tongue affords two channels in which the filter rods supplied by the two conveyors are fashioned.

At the garniture tongue, the filter groups are wrapped in a strip of paper material to form two continuous filter rods. The rods feeding out of the garniture tongue are cut simultaneously at a single cutting station by a single cutting element.

The absolute and/or relative speeds of the garniture tongue are governed according to a signal from a sensor located upstream of the cutting station.

The sensor measures the relative phase between the two rods and between one of the two rods and the cutting element.

The expression "relative phase of the filter rods" means the relative distance of two predetermined filter plugs belonging to two different rods along the feed direction. For the rods to be cut correctly, this distance must be equal to a reference distance (at which the two rods are perfectly in phase with each other).

The expression "phase of one of the rods relative to the cutting element" means the relative position of a predetermined plug from one of the two rods relative to the position of the cutting element. For the rods to be cut correctly, this distance must be equal to a reference relative distance (at which the rod is in phase with the cutting head.

Governing the speeds of the two conveyors of the garniture tongue is necessary to make filters from dimensionally identical plugs, that is, in order to cut the filters correctly.

Thus, the absolute and/or relative speeds of the two conveyors are governed in real time in order to allow any phase differences between the two rods and between one of the two rods and the cutting head to be compensated.

During the release of the filter groups to the conveyors, the rotating member retains the two filter groups by keeping the suction means on in such a way that the two filter groups gently push—that is, by applying a slight force to—the other filter groups, which have already been placed on the garniture tongue conveyors.

That way, the rotating member compacts the filter groups positioned on the garniture tongue. In other words, it eliminates any gaps, or empty spaces, between the filter plugs in the same groups and forms two uninterrupted rows of filter groups.

One problem with this machine arises if the relative misalignment between the two rods is too high, that is to say, greater than a predetermined value.

In this condition, when the rotating member simultaneously transfers the two filter groups to the conveyors of the garniture tongue, one of the two filter groups being released may excessively compress the other groups already present on the conveyors and fall out of the flute on the rotating member, thus cancelling the effect of retaining the other filter group in the other flute. As a result, one or more filter groups are missing from the filter rod supplied to the garniture tongue and in the worst cases this may even cause a machine shutdown to allow the fault to be corrected.

This is worsened by the fact that the problem occurs relatively frequently because the filter segments supplied to the reservoirs have variable dimensions (typically of the order of a few tenths of a millimeter) on account of production tolerances. As a result, during machine operation, the two filter rods tend to go out of phase with each other and this can only be partly compensated by adjusting the relative speed of the garniture tongue conveyors.

SUMMARY OF THE INVENTION

The aim of this invention is to provide a machine and a method such as will be unaffected by the above mentioned drawback, that is to say, such as can guarantee the optimum operation of the garniture tongue.

Another aim of the invention is to provide a machine whereby any relative phase difference between the two filter rods at the cutting element can be easily eliminated.

The stated aims are achieved according to the invention in a machine for manufacturing composite filters whose features are as recited in one or more of the annexed claims, and in a method for manufacturing composite filters.

BRIEF DESCRIPTION OF THE DRAWINGS

The technical features of the invention, with reference to the above aims, are clearly described in the claims below and its advantages are apparent from the detailed description which follows, with reference to the accompanying drawings which illustrate a preferred, non-limiting example embodiment of the invention, and in which:

DESCRIPTION OF THE PREFERRED EMBODIMENTS

Figure 1:
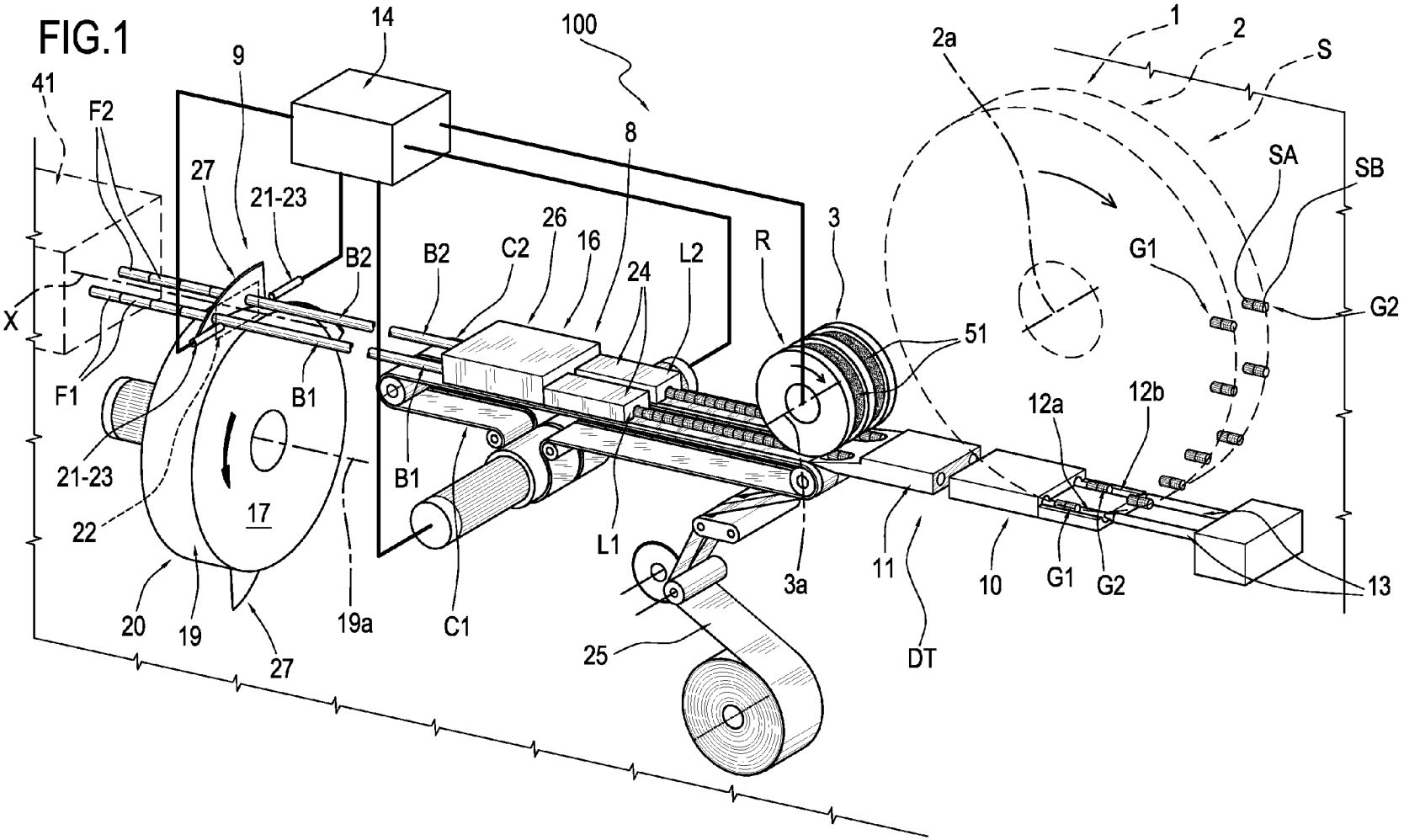
FIG. 1 is a schematic perspective view of the machine for manufacturing composite filters according to this invention.

With reference to the accompanying drawings, the numeral 100 denotes in its entirety a machine for making composite filters from two or more filter plugs.

The term "filter plug" as used herein means a piece of substantially uniform filter material, obtained preferably by cutting a segment of filter material. In other words, a filter plug is a portion of a segment of filter material.

The term "filter group" as used herein means a group of filter plugs of different types, that is to say, made of different materials and/or having different filtration properties, lined up longitudinally with each other.

The machine 100 comprises a rotating member, denoted by the reference numeral 1.

The rotating member 1, which is of substantially known type, is described in patent document EP1787534 in the name of the same Applicant as this invention and incorporated herein by reference.

Figure 2:
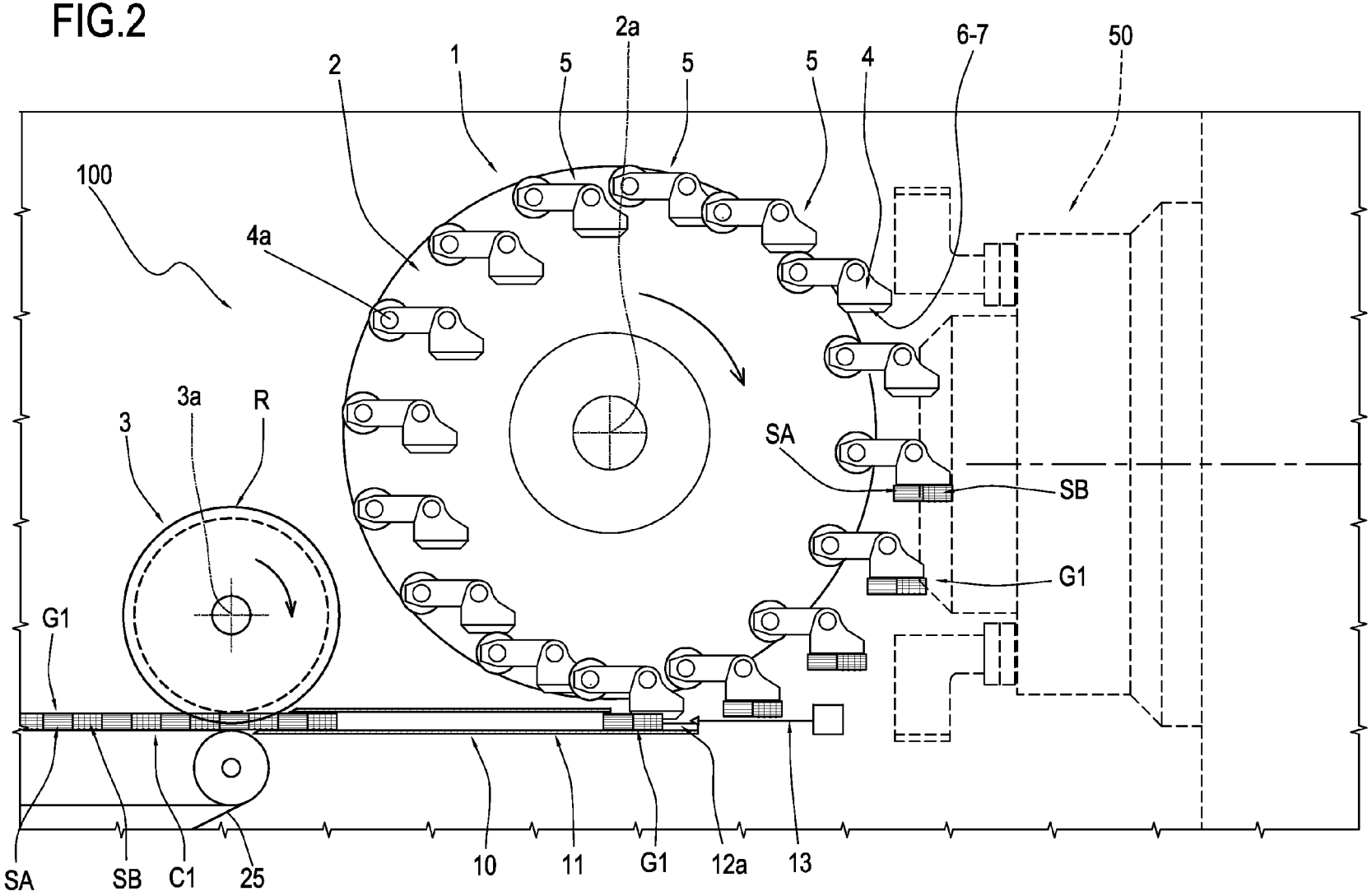
FIGS. 2 to 4 are side views of the machine of FIG. 1 in as many operating configurations.

The rotating member 1 is represented schematically in FIG. 1 and is shown more clearly in FIG. 2, and comprises a rotating body 2.

The rotating body 2 rotates about a horizontal axis 2*a*.

The rotating body 2 is equipped with a plurality of carriers 4, spaced at equal angular intervals and rotatable about respective axes of rotation 4*a* (the carriers 4 are illustrated in FIG. 2).

Each carrier 4 comprises a pick-up head 5 with two mutually parallel flutes 6, 7 for accommodating two distinct filter groups G1, G2.

The flutes 6, 7 of each pick-up head 5 are connected to a suction unit (not illustrated), which is turned on to hold the filter groups G1, G2 within the flutes 6, 7 of the pick-up head 5 and turned off to release them.

The rotating member 1 is configured to convey the filter groups G1, G2 while keeping the flutes 6, 7 of each carrier 4 substantially horizontal at all angular positions of the rotating body 2, as shown clearly in FIG. 2.

The rotating member 1 also conveys the filter groups G1, G2 longitudinally along their axes of longitudinal extension.

According to the invention, the rotating member 1 defines a feeder S for supplying pairs of filter groups G1, G2.

It should be noted that in other embodiments not illustrated the feeder S might be of a different type.

It should also be noted that the rotating member 1 is supplied by respective conveyors of known type forming part of an assembling unit (illustrated partly and schematically and labeled 50).

The assembling unit (not illustrated) is supplied with at least two segments of filter material of different types.

The segments are divided up to form a plurality of filter plugs which are conveyed transversally to their longitudinal axes by conveyor means.

The conveyors of the assembling unit combine the different filter plugs to form the filter groups G1, G2 comprising at least two filter plugs SA, SB made from different types of filter material.

The filter groups G1, G2 are then supplied to the rotating member 1.

The machine 100 further comprises a conveyor 10 designed to take up the filter groups G1, G2 from the feeder S (or rotating member 1) and to convey them along their direction X of longitudinal extension.

With reference to the preferred embodiment illustrated in FIGS. 1-4, the conveyor 10 is a pneumatic conveyor.

The pneumatic conveyor 10 comprises an element 11 presenting a pair of channels 12*a*, 12*b* extending along the direction X and nozzles 13 for blowing a stream of air.

Preferably, the channels 12*a*, 12*b* are transversally spaced by a distance equal to the spacing of the flutes 6, 7 of the pick-up head 5 of the rotating member 1.

The rotating member 1, as described in more detail below, releases each filter group G1, G2 to a channel 12*a*, 12*b*, that is to say, a first filter group G1 is released to the channel 12*a* and a second filter group G2 is released to the channel 12*b*.

The nozzles 13 are positioned and oriented relative to the element 11 in such a way that the air issuing from the nozzles 13 applies a pushing action along the direction X on the filter groups G1, G2 released by the feeder S. This allows the filter groups G1, G2 to be pushed along inside the channels 12*a*, 12*b* of the element 11 and made to advance along the direction X.

The pneumatic conveyor 10 defines a filter group G1, G2 transfer device DT by which the filter groups G1, G2 are taken up from the feeder S in pairs and directed separately along two distinct feed channels or lines L1, L2 along the direction X.

The machine 100 further comprises a wheel 3 which rotates about a respective central axis 3*a* and which is driven in rotation by drive means (not illustrated).

The axis 3*a* is parallel to the above mentioned axis 2*a*.

Preferably, the wheel 3 is furnished with circumferential grooves 51 defining seats for receiving the filter groups G1,G2.

As illustrated in FIG. 1, the wheel 3 comprises a pair of circumferential grooves 51, namely, a first groove for taking up the first filter groups G1 and a second groove for taking up the second filter groups G2.

The wheel 3 defines a release device R by which the filter groups G1, G2 are released in phase with each other to a garniture tongue 8.

In the preferred embodiment, the wheel 3 acts in conjunction with the transfer device DT to set the two filter groups G1, G2 in phase one with the other, as described in more detail below.

The wheel 3 is driven in rotation about the axis 3*a* through the agency of motor means (not illustrated), controlled by a control unit 14 also forming part of the machine 100.

The wheel 3 receives the filter groups G1, G2 from the pneumatic conveyor 10 and releases them, that is, transfers them, to conveyors C1, C2 of a garniture tongue 8 for forming two filter rods B1, B2.

The garniture tongue is denoted by the reference numeral 8 and also forms part of the machine 100.

The garniture tongue 8 comprises two conveyors C1, C2, each designed to convey one of the two filter groups G1, G2.

The conveyors C1, C2 direct the filter groups G1, G2 along two feed lines L1, L2 towards the garniture tongue 8.

Preferably, the conveyors C1, C2 of the garniture tongue 8 are conveyors of the type with belts.

The conveyors C1, C2 are designed to take up the filter groups G1, G2 released by the wheel 3 and to direct them to a garniture station 16 forming part of the garniture tongue 8.

The filter groups G1, G2 are progressively wrapped in a strip 25 of wrapping material placed above the conveyor belts C1, C2 to make the two continuous filter rods B1, B2 at the garniture station 16.

The strip 25 is preferably of paper material.

The garniture station 16 comprises a folding device 24 (represented schematically in FIG. 1) by which the strip 25 of wrapping material is fashioned around the filter groups G1, G2 and a gumming device 26 (also represented schematically in FIG. 1) for gluing to each other the longitudinal edges of the strip 25 of wrapping material.

In light of this, it should be noted that each filter rod B1, B2 is composed of an alternating succession of filter plugs SA, SB having different filtration properties and/or of different types, or each rod B1, B2 is composed of an aligned succession of first or second filter groups G1, G2.

The filter rods B1, B2 are then transferred by the conveyors C1, C2 of the garniture tongue 8 to a cutting station 9 downstream.

The cutting station 9 comprises a rotating cutting head 17 for dividing up the two filter rods B1, B2 along a predetermined cutting line.

The cutting head 17 simultaneously cuts the two filter rods B1, B2 to make composite filters F1, F2.

More specifically, the cutting head 17 comprises a rotating drum 19 driven by a respective motor (the latter not being illustrated).

The drum 19 rotates about an axis 19*a* which is substantially parallel to the feed direction X of the rods B1, B2 and has on its outer surface of revolution one or more knives 27.

Each knife 27 is inclined at an angle to the feed direction X of the continuous rods B1, B2.

The cutting head 17 is driven in such a way as to cut the rods B1, B2 cyclically at regular intervals.

The cutting head 17 constitutes cyclic cutting means 20 driven by respective motor means to divide up the two rods B1, B2 simultaneously into single composite filters F1, F2.

The machine 100 further comprises a sensor 21 which detects the passage of the plugs SA, SB of each filter rod B1, B2 at a detection region 22.

Preferably, the sensor 21 is configured to recognize the density and/or the color of the rod portion B1, B2 in transit through the detection region 22, in such a way as to identify the plugs SA, SB and send a corresponding signal to the control unit 14.

It should be noted that the control unit 14 can derive from the detection signal received from the sensor 21 the relative phase between the two rods B1, B2 and the relative phase between each rod B1, B2 and the knives 27 of the cutting head 17.

The expression "relative phase between the two filter rods" means the effective relative distance of two predetermined filter plugs SA, SB of one filter rod B1 relative to those of the other rod B2 along the feed direction X on the conveyors C1, C2. For cutting to be effected correctly, this distance must be equal to a reference distance corresponding to zero phase.

The expression "relative phase between one of the two rods and the cutting head" means the relative position of the plugs SA, SB constituting a filter rod B1, B2 along the direction X relative to the position of the knives 27 of the cutting head 17. For cutting to be effected correctly, this position, too, must be kept substantially equal to a reference position corresponding to zero phase.

According to the invention, the sensor 21 constitutes sensing means 23 serving to monitor the phase of at least one of the two rods B1, B2, preferably both rods, relative to the cutting means 20.

The sensor 21 also constitutes sensing means 23 serving to monitor the relative phase between the filter rods B1, B2.

Below is a description of a preferred mode of operation of the machine 100 according to the invention, with reference to FIGS. 2 to 4 which illustrate the steps performed in sequence by the machine 100 to release a pair of filter groups G1, G2.

In effect, it should be noted that the machine 100 is highly versatile and can operate in different modes depending on the driving speeds of its different component parts and/or on the configuration of the parts.

In light of this, it should be noted that the machine 100 can form one or two rows of filter groups G1, G2 on the two lines L1, L2 upstream of the wheel 3.

Figure 3:
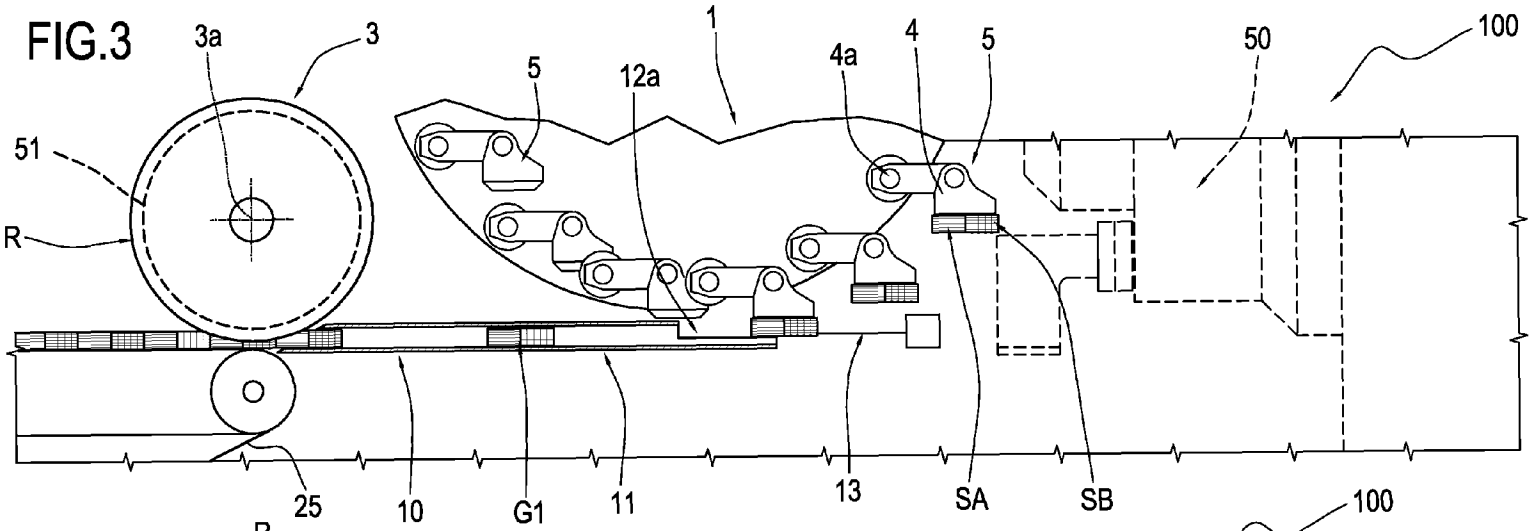
Figure 4:
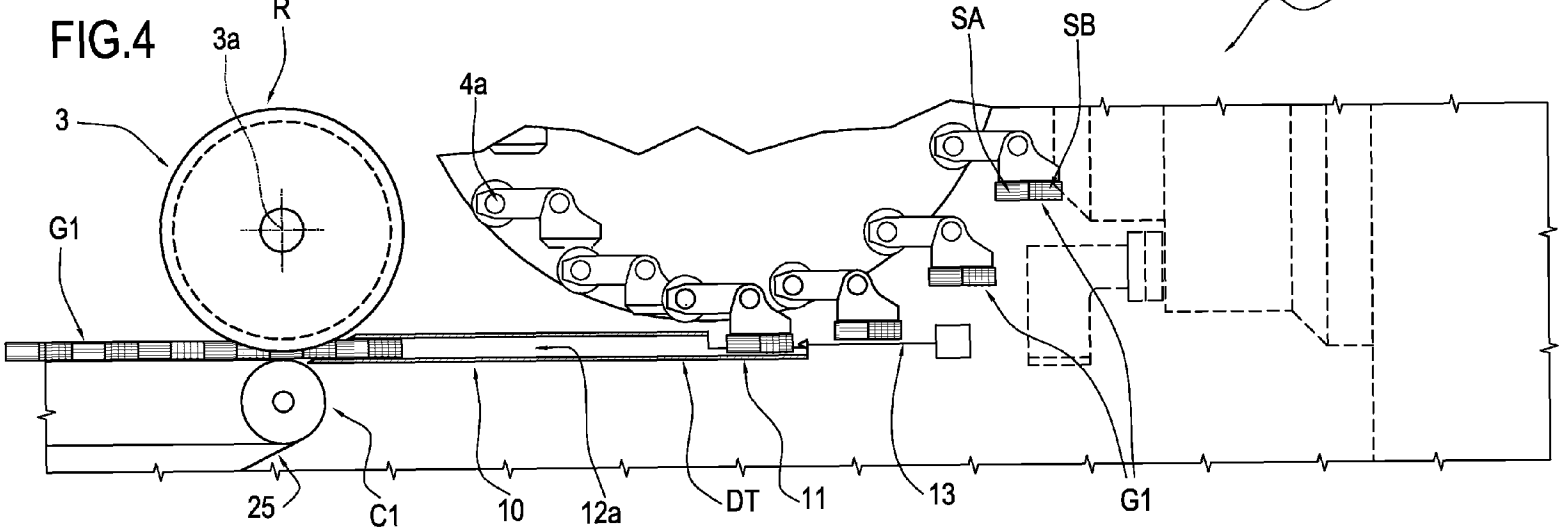

In the example of FIG. 2 the machine 100 is driven in such a way as to form, upstream of the wheel 3, two rows of filter groups G1 and G2 on the two distinct lines L1 and L2 (it should be noticed that FIGS. 2 to 4 show only the row of the first filter group G1 because the drawings are side views and the row of the second filter group G2 is hidden).

The rotating member 1 transfers the filter groups G1, G2 of each pick-up unit 5 by rotation about its axis 2*a*.

Each filter group G1, G2 is released to the pneumatic conveyor 10 when the respective flute 6, 7 of the pick-up head 5 is aligned with the respective groove 12*a*, 12*b* of the conveyor 10 itself (as illustrated in FIG. 2).

It should be noted that in FIG. 2 the lowermost carrier 4 is at the position for releasing the respective filter groups G1, G2 to the pneumatic conveyor 10.

The suction element (not illustrated) of the pick-up head 5 of the carrier 4 in the release position is switched off. After being switched off, the filter groups G1, G2 released by the rotating member 1 are pushed along the direction X by the stream of air issuing from the nozzles 13 (FIG. 3).

The filter groups G1, G2 released are pushed forward along the respective grooves 12*a*, 12*b* of the pneumatic conveyor 10 until coming into abutment with the filter groups G1, G2 already present in the grooves 12*a*, 12*b* of the pneumatic conveyor 10 (FIG. 4) or, if there are no filter groups G1, G2 lined up in the grooves 12*a*, 12*b* of the pneumatic conveyor 10, until coming into abutment with the walls of the grooves 51 of the wheel 3.

It should be noted that the wheel 3 moves the plugs SA, SB making up the filter groups G1, G2 substantially by friction, making the filter groups G1, G2 advance until releasing them to the conveyors C1, C2 of the garniture tongue 8.

The conveyors C1, C2 of the garniture tongue 8 are driven at a constant speed to feed the two continuous filter rods B1, B2 towards the cutting station 9.

In the cutting station 9, the two filter rods B1, B2 must be cut precisely at a predetermined position.

The sensor 21 of the machine 100 detects each plug SA, SB of the two filter rods B1, B2 as it passes the detection region 22 and sends a corresponding signal to the control unit 14.

From the signal of the sensor 21, the control unit 14 derives a relative phase value of the two filter rods B1, B2 and a phase value of one of the two filter rods B1, B2 relative to the cutting head 17.

According to the invention, the control unit 14 might also derive only the phase value of one of the two filter rods B1, B2 relative to the cutting head 17.

It should be noted that the control unit 14 is connected to the cutting head 17, to the sensor 21, to the wheel 3 and, preferably, as illustrated in FIG. 1, also to the conveyors C1, C2 of the garniture tongue 8.

The control unit 14 governs the speed of the wheel 3 as a function of the derived value of the phase between one of the two rods B1, B2 and the cyclic cutting means 20. Thus, the wheel 3 supplies the garniture tongue 8 at a rate controlled by the control unit 14.

By way of an example, if the two filter rods are out of phase relative to the cutting head 17 (or the cutting lines of both filter rods B1, B2 are displaced by the same amount relative to the reference position) and, more specifically, if a delay relative to the cutting head 17 is detected, the wheel 3 is accelerated to supply the conveyors C1, C2 of the garniture tongue 8 at a faster rate.

According to another aspect of the invention, the control unit 14 is programmed to control also the speed of both conveyors C1, C2 of the garniture tongue 8.

More specifically, according to this aspect, the control unit coordinates the speed of both conveyors C1, C2 of the garniture tongue 8 with the speed of the wheel 3 as a function of the phase signal of one of the two filter rods B1, B2 relative to the cutting means 20.

It should be noted that according to a yet further aspect, the control unit 14 also controls and governs the relative speeds of the two conveyors C1, C2 of the garniture tongue 8 in such a way as to compensate for any relative phase difference between the two filter rods B1, B2, detected by the sensor 21.

In this regard, it should be noted that if no phase differences between the two filter rods B1, B2 and the cutting means 20 are detected, the wheel 3 is driven at a constant speed.

The advantages of the invention are described briefly below.

The main advantage of the machine 100 lies in the wheel 3 and in the pneumatic conveyor 10, that is to say, in the release device R and transfer device DT. More specifically, the wheel 3 allows the filter groups G1, G2 of the two distinct lines L1, L2 to be set in phase with each other before completely releasing the groups G1, G2 to the conveyors C1, C2 of the garniture tongue 8.

In effect, it should be noted, in this regard, that if one of the two filter groups G1, G2 is released by the rotating member 1 in advance of the other, the wheel 3 can slow it down more than the other so as to align—that is, set at zero relative phase—the two groups released upstream of the conveyors C1, C2 of the garniture tongue 8.

The length of the two rows of filter groups G1, G2 in the transfer device DT is modified as a function of the drive speed of the wheel 3. Thus, the grooves 12*a* and 12*b* of the element 11 define, according to the invention, a buffer which can accommodate a variable length row of filter groups G1, G2 to compensate for any slowdowns/accelerations of the wheel 3 relative to the rotating member 1.

The release device R, in combination with the transfer device DT allows the operation of the rotating member 1 to be uncoupled from that of the conveyors C1, C2 of the garniture tongue 8.

In effect, it should be noted that in the machine 100 according to the invention, the rotating member 1 merely transfers the filter groups G1, G2 to the pneumatic conveyor 10 without in any way compacting the filter groups G1, G2, as occurred, instead, in the prior art solutions.

The term "compacting" as used in this description means creating an uninterrupted row of filter plugs SA, SB placed in end-to-end contact, that is to say, creating a longitudinal row of filter plugs without gaps or empty spaces between them.

That way, during the step of releasing the filter groups G1, G2, the rotating member 1 of the machine 100 is unaffected by the drawbacks typical of the known solutions and, advantageously, its speed can be governed in such a way as to optimize it relative to the speed of the parts upstream.

In light of this, it should be noted that the effect of the control unit 14 governing the relative speed of the conveyors C1, C2 to compensate for any phase differences between the two filter rods B1, B2 is applied only to the wheel 3 and to the conveyor 10—that is, to the length of the row of filter groups in the conveyor 10. This avoids problems during the step of releasing the filter groups G1, G2 by the rotating member 1, overcoming the above described drawback of the prior art machines due to incorrect releasing and consequent incorrect supplying of the garniture tongue 8.

In yet another embodiment, the control unit 14 governs the nozzles 13 and activates them according to a predetermined sequence to control the conveying speed of the pneumatic conveyor 10.

Advantageously, the control unit 14 governs the nozzles 13 as a function of the monitored phase value of at least one filter rod B1, B2 relative to the cutting means 20.

In a further embodiment, the nozzles 13 are controlled independently in order to govern the relative conveying speed in the two lines L1, L2 of the pneumatic conveyor 10.

Figure 7:
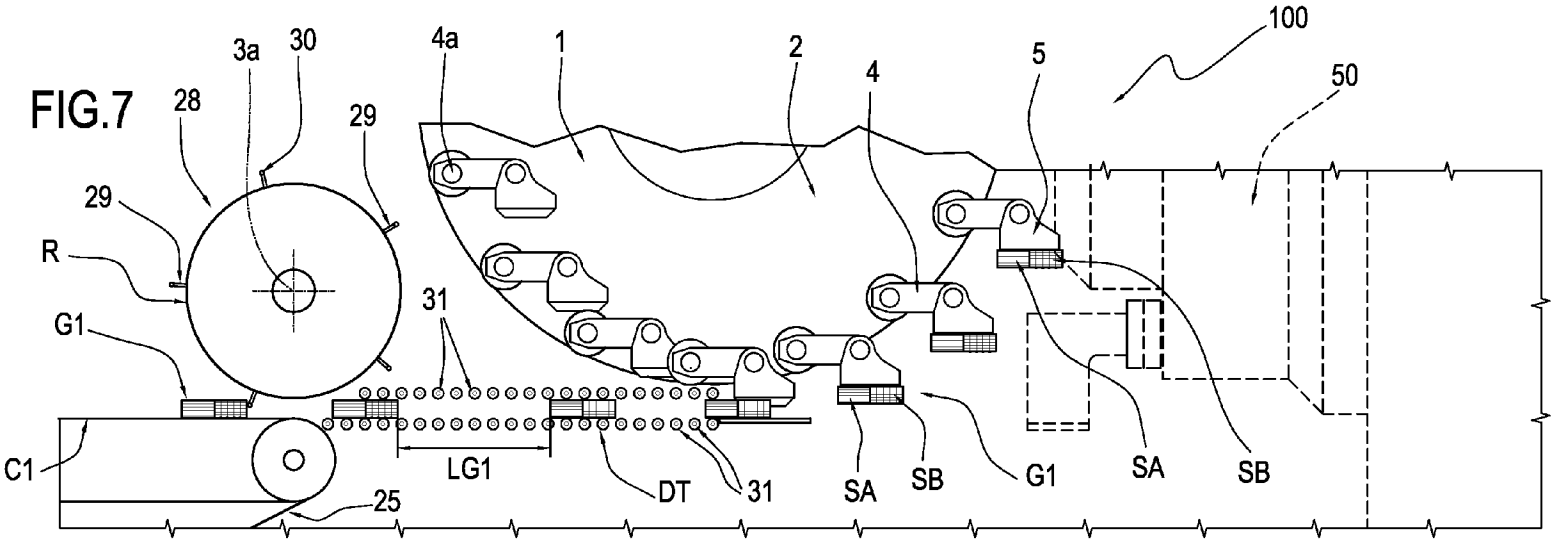

In a yet further embodiment, illustrated in FIG. 7, the machine 100 comprises, instead of the wheel 3 with the circumferential grooves 51, a wheel 28 equipped with a plurality of paddles 29 by which the filter groups G1, G2 released by the pick-up heads 5 are engaged in such a way as to bring about their release onto the conveyors C1, C2 of the garniture tongue 8.

The paddles 29 protrude radially and are preferably furnished with an axially projecting pin 30 by which the filter groups G1, G2 are engaged in such a way as to push/retain them.

In this variant embodiment, the wheel 28 furnished with paddles 29, hereinafter also referred to as paddle wheel 28, constitutes the release device R described above with reference to the wheel 3 of the preferred embodiment.

This embodiment also preferably comprises, instead of the pneumatic conveyor 10, a conveyor comprising a plurality of wheels 31, hereinafter also referred to as wheel conveyor 31.

The wheel conveyor 31 comprises a plurality of wheels 31 driven in rotation by respective drive means (not illustrated).

The wheels 31 are designed to engage the filter groups G1, G2 released by the carriers of the rotating member 1 and to direct them along a predetermined conveyor path.

Preferably, the wheel conveyor 31 comprises first wheels, designed to engage and direct the first filter groups G1, and second wheels, designed to engage and direct the second filter groups G2.

Alternatively, the wheel conveyor 31 comprises a single group of wheels 31 designed to transfer both filter groups G1, G2 to the release device R.

It should be noted that the wheels 31 can advantageously accelerate the filter groups G1, G2 released by the rotating member 1 thereby spacing them from each other in such a way as to create a predetermined space LG1—or gap—between one filter group G1, G2 and another.

This makes it possible to fill the gap LG1 between one filter group and the next for example with granular material in order to make filters F1, F2 comprising a filter portion made from granular material.

Thus, the machine 100 might advantageously also comprise a unit (not illustrated) for releasing granular material, located preferably downstream of the paddle wheel 28.

Attention is thus drawn to the versatility of the machine 100, which can be equipped with the wheel conveyor 31 and with the paddle wheel 29 in order to advantageously be able to space the filter groups from each other upstream of the wheel 28.

Also, the gap LG1 created between one filter group G1, G2 and the next makes it possible to avoid breaking or damaging the filter plugs SA, SB making up the filter groups when a filter group G1, G2 is engaged by a paddle 29.

It should be noted that each paddle 29 is designed to engage a filter group G1, G2 and direct it downstream of the wheel 28 to supply it to the conveyors C1, C2 of the garniture tongue 8.

Figure 6:
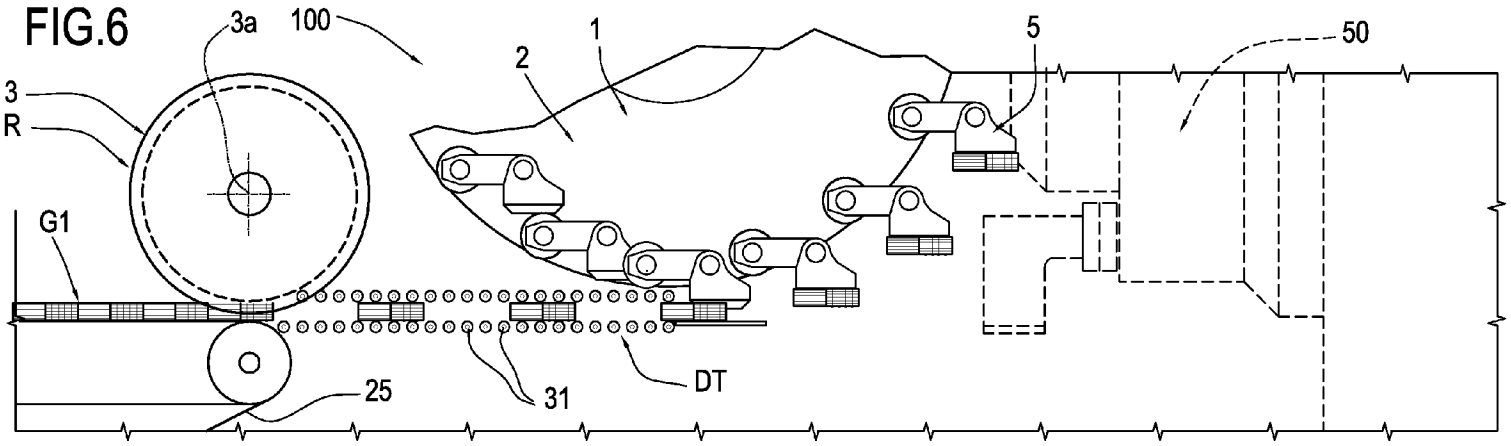
FIGS. 6 and 7 are side views of two different alternative embodiments of the machine for manufacturing composite filters according to this invention.

FIG. 6 shows a variant where the machine 100 comprises a wheel 3 furnished with grooves 51, and the wheel conveyor 31 described above.

This variant has the same technical and functional features as those described with reference to the preferred embodiment and will not therefore be further described.

Figure 5:
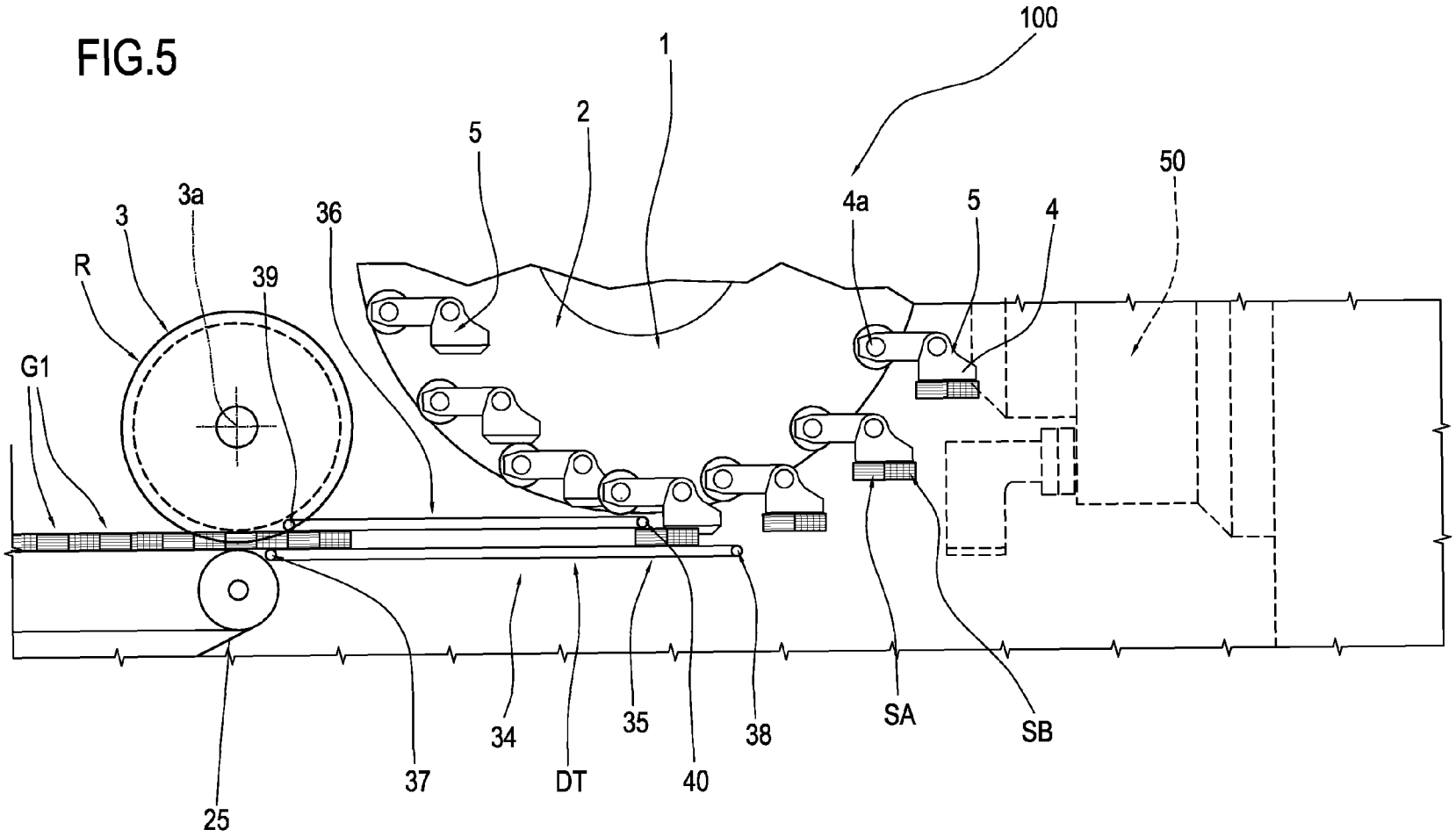
FIG. 5 is a side view of another embodiment of the machine for manufacturing composite filters according to this invention.

FIG. 5 shows a variant embodiment where the machine 100 comprises, instead of the pneumatic conveyor 10, a belt conveyor 34.

The belt conveyor 34 comprises a pair of belts 35, 36, namely, an upper belt 36 and a lower belt 35.

Each belt 35, 36 is trained around respective end rollers 37, 38; 39, 40, driven in rotation by drive means not illustrated.

The belt conveyor 34 serves the same function as the pneumatic conveyor 10, that is to say, it allows transfer of the filter groups G1, G2 released by the rotating member 1 to the release device R and acts in conjunction with the release device R to allow the two filter groups G1, G2 of the two lines L1, L2 to be aligned, that is to say, phased, with each other.

Figure 8:
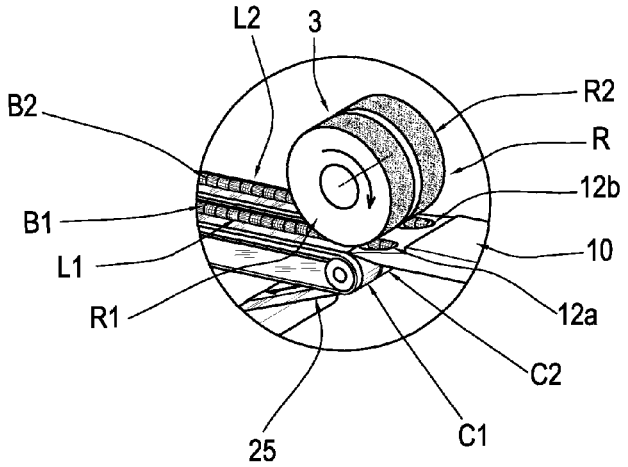
FIG. 8 shows a detail of a variant of the machine of FIG. 1.

In a variant embodiment illustrated in FIG. 8 the machine 100 comprises a pair of release devices R, each associated with one of the two lines L1, L2.

For clarity, the release devices R have been individually labeled R1 and R2.

In particular, by way of a non-limiting example, the release devices R1 and R2 of FIG. 8 are defined by a pair of wheels 3 having the same functional features as those described with reference to the wheel 3 of the preferred embodiment of the machine 100.

In the variant illustrated in FIG. 8 the wheels 3 are, at least on the surface of them, made of an elastic material which is deformable so that the filter groups G1, G2 can be fed forward by friction.

The two release devices R1, R2 are preferably driven by respective drive means which are independent of each other. In other words, the speed of each wheel 3 can advantageously be governed independently of the speed of the other.

In light of this, it should be noted that according to the invention the control unit 14 governs the speed of both wheels 3 as a function of the phase value between each filter rod B1, B2 and the cutting head 17.

It is also possible to govern the relative speed of the two wheels 3 as a function of the monitored relative phase value between the filter rods B1, B2. According to this aspect, any relative phase differences between the two filter rods B1, B2 that might arise downstream of the garniture tongue 8 can advantageously be compensated. Advantageously, that means, unlike the solutions known up to now, that there is no need for any further adjustment of the speed of the conveyors C1, C2 of the garniture tongue 8.

In effect, as is known, adjusting the speed of the conveyors C1, C2 of the garniture tongue 8 to reduce the relative phase difference between the two filter rods B1, B2 is in many cases not very effective because the filter groups G1, G2 are already partly wrapped in the strip 25 of wrapping material and thus any relative movement between the groups G1 of one filter rod B1 relative to the groups G2 of the other filter rod B2 along the direction X is not precise and is difficult to implement.

Advantageously, this variant therefore also allows the relative phase between the two filter rods B1, B2 to be controlled highly effectively and precisely upstream of the conveyors C1, C2 of the garniture tongue.

It should be noted, however, that the wheel 3 and the pneumatic conveyor 10 of the machine 100, even without control of the relative speed of the two release devices R1 and R2, make it possible to eliminate any phase differences between the filter rods downstream of the garniture tongue 8.

Preferably, according to this variant, the machine 100 comprises, for each filter group G1, G2, an independent transfer device DT acting in conjunction with the respective release device R1, R2.

In short, it should be noted that according to this variant embodiment, there is a transfer device DT and a release device R for each filter group G1, G2- or line L1, L2.

Figure 9:
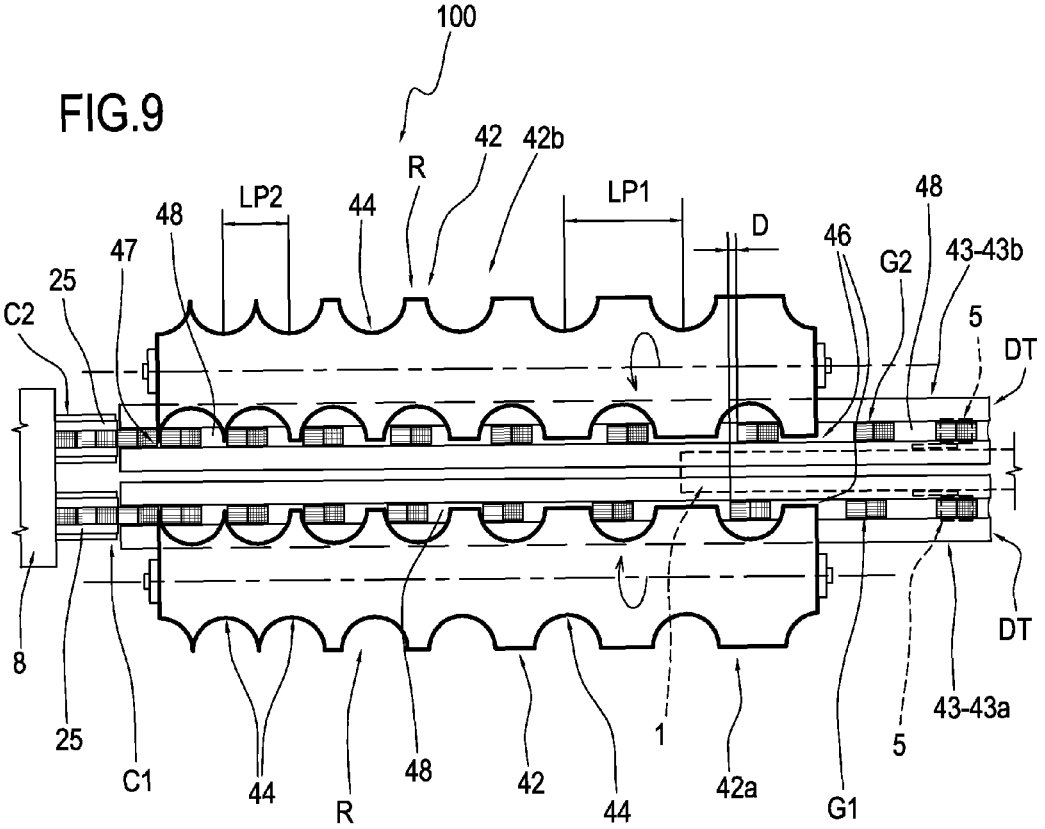
FIG. 9 shows a schematic plan view of yet another variant embodiment of the machine according to the invention.

In a further variant embodiment, illustrated in FIG. 9, the release device R comprises two variable pitch augers 42, each independently driven in rotation about a respective axis of rotation.

For clarity, the two augers 42 of FIG. 9, namely a first auger and a second auger, are individually labeled 42*a* and 42*b*, respectively.

Each auger 42 is configured to receive the filter groups G1, G2 conveyed by the transfer device DT and to rotate about a respective central axis.

Preferably, in this variant embodiment, the transfer device DT comprises a vacuum type conveyor 43.

Preferably and without limiting the invention, as illustrated by way of non-limiting example in FIG. 9, the machine 100 comprises a first 43*a* and a second 43*b* vacuum type conveyor 43, each designed to carry and transfer a respective filter group G1, G2 to one of the two augers 42*a*, 42*b*.

It should be noted that each vacuum type conveyor 43*a*, 43*b* is furnished with a seat (denoted by the reference numeral 48) containing the filter groups G1, G2 being fed forward.

Preferably, but not necessarily, each auger 42 is a screw with multiple starts which are substantially identical but angularly offset. In this regard, however, it should be noted that each auger 42 in FIG. 9 has only one start.

Advantageously, with the rotating member 1 releasing filter groups G1, G2 which are equal in number and size in a predetermined time interval, a multiple start auger 42 can be driven in rotation at a slower speed than a single-start auger to release the filter groups G1, G2 to the conveyors C1, C2 of the garniture tongue 8 at the same rate.

It should also be noted that in the embodiment shown in FIG. 9, the pitch of each auger 42*a*, 42*b*, that is, the distance between the thread roots 44, decreases along the axial direction of the auger 42 itself relative to the conveying direction of the filter groups G1 and G2 (in effect, the length LP1, corresponding to the pitch at the infeed end of the auger 42, is greater than the length LP2, corresponding to the pitch at the outfeed end of the auger 42).

In other words, the pitch at the infeed end 46 of the auger 42 of FIG. 9 is greater than the pitch at the outfeed end 47.

Alternatively, the machine 100 may comprise a single auger (not illustrated), with at least two starts at a suitable angular offset, by which both filter groups are engaged simultaneously.

The operation of the machine 100 with the augers 42*a* and 42*b* is described briefly below with reference to the embodiment illustrated by way of non-limiting example in FIG. 9.

In FIG. 9, the filter groups G1 and G2 feeding into the respective augers 42*a*, 42*b* are not in phase with each other, that is to say, there is a longitudinal misalignment or phase difference, labeled D, between the two filter groups G1, G2. More specifically, the first group G1 is ahead of the second group G2.

FIG. 9 shows the same filter groups G1, G2 present at the infeed ends of the augers 42*a*, 42*b* at successive moments in time, that is to say, occupying successive positions, along the axial direction of the auger.

Between its infeed end 46 and its outfeed end 47, the auger 42 applies a greater slowing action on the first group G1, that is to say, on the group which is ahead at the infeed end 46 of the auger 42, and a smaller slowing action on the second group, that is to say, on the group which is behind at the infeed end 46 of the auger 42. This advantageously allows the two groups G1, G2 to be released at the outfeed ends of the augers 42*a* and 42*b* in phase with each other, that is, aligned, as may be seen in FIG. 9.

In effect, the rear portion of the threading of the auger 42 applies a slowing action on the filter groups G1, G2 being fed forward by the respective vacuum type conveyor 43.

The smaller pitch at the outfeed end 47 of each auger 42 advantageously allows the filter groups of each line L1, L2 to be compacted before being released to the conveyors C1, C2 of the garniture tongue 8.

In the same way as the wheel 3, the auger is advantageously controlled by the control unit 14, which governs its speed as a function of the signal received from the sensor 21 and of the phase of the cutting head 17 according to the technical and functional features described above with reference to the wheel 3 of the preferred embodiment.

In variant embodiments not illustrated in the drawings, the variation of the pitch of the auger 42 may be distributed differently along the axial direction.

More specifically, the auger 42 may be designed to space the filter groups G1, G2 from each other, that is, to space each first filter group G1 from the next first filter group released by the rotating member 1 and to space each second filter group G2 from the next second filter group released by the rotating member 1.

In other words, according to this variant, the auger is designed to serve as an accelerating element that creates between one filter group and the next in each line L1, L2 empty spaces which may or may not be filled, depending on the type of filter to be made.

According to this variant, the pitch at the outfeed end of the auger is greater than the pitch at the infeed end of the auger.

Set out in brief below are some general consideration regarding the machine 100.

The release device R of the machine 100 may comprise, preferably and alternatively:

a wheel 3 furnished with circumferential grooves 51;

a wheel 3 of deformable material;

a paddle wheel 28;

a variable pitch auger 42.

Further, the transfer device DT may comprise, preferably and alternatively:

a pneumatic conveyor 10;

a wheel conveyor 31;

a belt conveyor 34;

a vacuum type conveyor 43.

The release and transfer devices R and DT can be combined in any way, all the possible combinations falling within the scope of the invention.

It should also be noted that the machine 100 may comprise either a single release device R operating on both filter groups G1, G2 released by the rotating member 1 or a pair of release devices R1, R2, each operating on one of the two filter groups G1, G2.

Further, the machine 100 may also comprise either a single filter group G1, G2 transfer device DT operating on both filter groups G1, G2, or a pair of filter group G1, G2 transfer devices DT, each operating on one of the two filter groups G1, G2.

It should also be noted that the filters F1, F2 made by the machine 100 according to the invention are supplied to a further unit 41, illustrated schematically in FIG. 1, which attaches each filter F1, F2 to a respective cigarette rod.

The invention described above is susceptible of industrial application and may be modified and adapted in several ways without thereby departing from the scope of the inventive concept. Moreover, all the details of the invention may be substituted by technically equivalent elements.

What is claimed is:

1. A machine for manufacturing composite filters attachable to cigarettes or other tobacco items, the machine comprising:

a feed conveyor supplying pairs of filter groups, each group comprising at least two longitudinally aligned filter plugs;

a forming station for forming two continuous filter rods, comprising a garniture tongue on which the two rods are assembled, wherein the garniture tongue comprises a garniture station, at which the filter groups are progressively wrapped in a strip of wrapping material to obtain filter rods, and two conveyors each designed to convey one of the two filter groups along a respective feed line towards the garniture station;

a cyclic cutting mechanism by which the two continuous filter rods are divided up simultaneously to produce corresponding composite filters;

a sensor serving to monitor a phase value of at least one of the rods, relative to the cutting mechanism;

at least one transfer device, located between the feed conveyor and the two conveyors of the garniture tongue and by which the filter groups are drawn from the feed conveyor and directed along the feed lines;

at least one release device, located between the at least one transfer device and the two conveyors of the garniture tongue, by which the two filter groups are drawn from the transfer device and released in phase one with another on the two conveyors;

a control unit connected to the sensor and to the release device and governing a rate at which the filter groups are released by the release device, according to a monitored phase value of at least one of the continuous filter rods relative to the cutting mechanism.

2. A machine as in claim 1, wherein the control unit is connected also to the at least one transfer device so as to govern the rate at which the filter groups are conveyed through the device, according to the monitored phase value.

3. A machine as in claim 1, comprising a sensor serving to monitor a relative phase value of the rods, and first and second release devices of which relative release rates are governable additionally by the control unit according to the monitored relative phase value of the two rods, each release device being designed to release one of the two filter groups along one of the feed lines.

4. A machine as in claim 1, wherein the filter groups are transferred by first and second transfer devices, each designed to draw and convey one of the filter groups received from the feed conveyor.

5. A machine as in claim 1, comprising a sensor serving to monitor a relative phase value of the rods, and wherein relative rates at which the filter groups advance along the feed lines of the garniture tongue are governed according to the monitored relative phase value of the rods.

6. A machine as in claim 1, wherein the release device comprises a wheel driven in rotation as to bring about the release of at least one of the filter groups.

7. A machine as in claim 6, wherein the wheel is equipped with paddles by which the filter groups are engaged in such a way as to bring about their release onto the feed lines of the garniture tongue.

8. A machine as in claim 6, wherein the wheel is furnished with circumferential grooves by which the filter groups are engaged.

9. A machine as in claim 1, wherein the release device comprises at least one variable pitch auger.

10. A machine as in claim 1, wherein the transfer device comprises a vacuum type conveyor.

11. A machine as in claim 1, wherein the filter groups are transferred by a transfer device comprising a pneumatic conveyor.

12. A machine as in claim 11, wherein the pneumatic conveyor comprises an element including guide channels accommodating the filter groups and constituting a portion of the feed lines, and also a blower by which a stream of air is directed along the feed lines to effect the transfer of the filter groups.

13. A machine as in claim 1, wherein the filter groups are transferred by a transfer device comprising a conveyor equipped with belts.

14. A machine as in claim 1, wherein the filter groups are transferred by a transfer device comprising a conveyor equipped with a plurality of wheels which are drivable in rotation.

15. A method of manufacturing composite filters for cigarettes or the like, comprising:

supplying filter groups in pairs, each group comprising at least two longitudinally aligned filter plugs;

enveloping the filter groups in relative strips of plugwrap material along a garniture tongue having two parallel conveyors in such a way as to form two continuous filter rods;

dividing the continuous filter rods into discrete filters with a cyclic cutting mechanism;

monitoring the phase of at least one of the rods relative to the cyclic cutting mechanism, and, after the supplying the pairs of filter groups and before the enveloping the filter groups, the following carried out by a transfer device:

drawing the filter groups from a feed conveyor; and transferring the filter groups along two feed lines defined by the two conveyors;

wherein the transferring the filter groups, drawn from the feed conveyor, along the two feed lines is followed by releasing the filter groups on the two conveyors of the garniture tongue in phase one with another by at least one release device located between the transfer device and the two conveyors of the garniture tongue;

and wherein a rate at which the groups are released is controlled according to the monitored phase of at least one rod relative to the cyclic cutting mechanism.

16. A method as in claim 15, wherein the step of supplying the filter groups comprises causing the groups to advance parallel with their longitudinal axes.

17. A method as in claim 15, wherein a rate at which the filter groups are transferred along the feed lines upstream of the release point is also controlled according to the monitored phase of at least one rod relative to the cyclic cutting mechanism.

18. A method as in claim 15, and further comprising monitoring a relative phase value of the two rods, and wherein the relative rate at which the filter groups are transferred along the feed lines downstream of the release point is controlled according to the monitored relative phase value of the two rods.

19. A method as in claim 15, and further comprising monitoring a relative phase value of the two rods, and wherein the relative rates at which the filter groups are released are controlled according to the monitored relative phase value of the two rods.

20. A method as in claim 15, and further comprising monitoring a relative phase value of the two rods, and wherein the step of transferring the filter groups comprises the step of controlling the relative rates at which the filter groups are transferred along the two feed lines according to the monitored relative phase value of the two rods.

* * * * *